US008912974B2

(12) United States Patent
Green et al.

(10) Patent No.: US 8,912,974 B2
(45) Date of Patent: Dec. 16, 2014

(54) SOLDERLESS CIRCULARLY POLARIZED MICROWAVE ANTENNA ELEMENT

(75) Inventors: David Green, Alexandria, VA (US); Cornelis Frederik Du Toit, Ellicott City, MD (US)

(73) Assignee: The United State of America as represented by the Administrator of the National Aeronautics Space Administration, Washington, DC (US)

( * ) Notice: Subject to any disclaimer, the term of this patent is extended or adjusted under 35 U.S.C. 154(b) by 568 days.

(21) Appl. No.: 13/222,575

(22) Filed: Aug. 31, 2011

(65) Prior Publication Data

US 2013/0050048 A1 Feb. 28, 2013

(51) Int. Cl.

| | |
|---|---|
| ***H01Q 1/50*** | (2006.01) |
| ***H01Q 9/04*** | (2006.01) |
| ***H01Q 23/00*** | (2006.01) |
| ***H01Q 21/30*** | (2006.01) |

(52) U.S. Cl.

CPC ..... *H01Q 23/00* (2013.01); *H01Q 9/0478* (2013.01); *H01Q 21/30* (2013.01)

USPC ..... 343/860; 343/850; 343/700 MS

(58) Field of Classification Search

USPC ..... 343/860

See application file for complete search history.

(56) References Cited

U.S. PATENT DOCUMENTS

| | | | | |
|---|---|---|---|---|
| 4,825,223 | A * | 4/1989 | Moore | 343/840 |
| 7,123,203 | B2 * | 10/2006 | Le Geoff et al. | 343/725 |
| 2002/0075197 | A1 * | 6/2002 | Shrader | 343/840 |

FOREIGN PATENT DOCUMENTS

| | | | | |
|---|---|---|---|---|
| EP | 0393875 B1 * | 1/1995 | ..... | H01Q 11/10 |

* cited by examiner

*Primary Examiner* — Dameon E Levi
*Assistant Examiner* — Andrea Lindgren Baltzel

(57) ABSTRACT

Disclosed herein is an antenna feed design for transmitting or receiving a circularly polarized microwave signal, and a communication device using that antenna feed design. Resonating disks are bowl-shaped to balance E-plane and H-plane magnetic field patterns, decreasing cross-polarization, and providing mechanical rigidity. A non-planar circuit replaces planar microstrip transmission lines for transmitting the signal, with 90° phase shifts, from an input point to excitation points. This non-planar circuit overcomes some of the layout problems encountered in planar circuits. It maintains impedance matching from the input point to the excitation points by progressively tapering down the characteristic transmission line impedance of each successive section. The non-planar circuit has sufficient mechanical strength and rigidity to allow it to be supported at only two anchor points. Similarly, the non-planar disks are also of sufficient strength to require only a single anchor point each. Thus, the antenna parts do not require any additional dielectric substrate support, and all parts are DC grounded. The use of fingers surrounding the ground plane and extending towards the resonating disks results in improved off-boresight polarization. All components of the antenna feed are built and combined without the use of solder or dielectric substrate support, creating a stable, corrosion-resistant, low-cross polarization antenna.

17 Claims, 7 Drawing Sheets

SOLDERLESS CIRCULARLY POLARIZED MICROWAVE ANTENNA ELEMENT

BACKGROUND

1. Technical Field

The present disclosure relates to antenna design and more specifically to a solderless antenna feed for transmitting and/or receiving a circularly polarized microwave signal.

2. Introduction

Microwave transmission signals are typically transmitted with either linear or circular polarization. In linear polarization, the receiving antenna aligns its frame of reference with the transmitting antenna to achieve acceptable communications. Because this frame of reference can change depending on factors such as feed and reflector orientation, as well as Faraday rotation, antenna designers often exchange linear polarization for circular polarization, which is less affected by such factors. Circular polarization creates a rotating electric field resulting from two orthogonal linear components $E_x$ and $E_y$, where both $E_x$ and $E_y$ have sinusoidally varying magnitudes equal in amplitude and 90° out of phase with one another. As $E_x$ and $E_y$ vary sinusoidally, a rotating signal is created by combining the horizontal polarization $E_x$ and the vertical polarization $E_y$.

A common method of creating a circularly polarized signal is to connect a single antenna patch or a set of antenna patches to a feed network which rotates sequentially, with uniform angular spacing between feed points. Due to uniform angular spacing, uniform phase differences of 90° exist between each feed point. As the feed network rotates the signal phase, the feed points sequentially contact the antenna patch or patches with the signal 90° out of phase at each contacting feed point, creating a rotating signal within the antenna.

Microstrip transmission lines, also referred to as circuits, are commonly used to create accurate feed networks. Microstrip transmission lines are pieces of conductive material in the form of narrow strips near a wider grounded conductor which conduct the signal in this application to antenna feed points such that the signal undergoes a 90° phase shift between each feed point. This phase shift occurs by determining specific lengths of the transmission lines to provide the appropriate phase shifts. Because of the thin, planar nature of microstrip transmission lines, a dielectric substrate, which could be solid or a lightweight rigid honeycomb material, often supports the microstrip transmission lines. One disadvantage of traditional microstrip transmission line designs is the use of solder, and particularly the need to solder the microstrip transmission lines to the input points and antenna feed points. Extreme heat, cold, corrosion, or vibration, such as those found in space-based applications, can damage solder joints and break or reduce the signal transmission and reception characteristics of the antenna.

In an ideal, perfect antenna, the creation of the circularly polarized microwave signal would have no energy loss. However for real antennas, energy is lost in three ways: A small fraction of the energy is dissipated as heat and is minimized by using good conducting materials. More significant amounts of energy are lost in the feed network by being reflected back and when the signal conversion to transmitted radiation or from received radiation involves cross-polarization. The reflection loss is minimized by optimizing wave impedance matching in the feed network. Circular cross-polarization occurs due to the lack of a perfect 90° phase shift and/or equal signal amplitude between the two orthogonal linear field components. A cross-polarized signal is a signal polarized orthogonally to the desired polarization. For example, if a transmitting, circularly polarized antenna is creating a Right Hand Circularly Polarized (RHCP) signal, a cross-polarization signal can also be created which is Left Hand Circularly Polarized (LHCP). The cross-polarization weakens the effective signal strength of the intended signal. Therefore, reduction of cross-polarization transmitted or received by the antenna is a desirable characteristic.

SUMMARY

Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

Disclosed herein is an antenna design that requires no solder, thereby increasing reliability, and which can generate and/or receive circularly polarized signals. Instead, all parts are mechanically supported via metal to metal clamping and screw attachments. Similarly, no dielectric is required, although certain embodiments can incorporate a small amount of dielectric material, such as in the input connection. In one exemplary embodiment, all components, except for the final resonance disk on a first end of the antenna, and the lid on the second end of the antenna, contain apertures. A central pin then connects to the final resonance disk, passes through the apertures of all the components, and attaches to the lid on the second end of the antenna. Attachment of the central pin to the final resonance disk and to the lid can occur through threading, nuts, crimping, or other means for securing a pin or screw to a component known within the art.

In another aspect, the central post supports one or more radiating disks, or resonance disks. These disks, which can be electromagnetically coupled, resonate at specific frequencies and power levels, creating a microwave signal. Having two disks stacked together creates a wider operational impedance matching bandwidth than a single disk. The system can incorporate a single disk, two disks, or more than two disks, depending on the desired performance characteristics. The disks can be bowl shaped, and in one embodiment the final resonance disk faces down and the penultimate disk faces up, or in other words, the concave portions of the disks face each other. The radii of curvature of the bowl shaped disks, and whether the bowls are turned up or down, provides a mechanism to help balance the E- and H-plane patterns of the antenna over large angles away from the boresight. In addition, the bowl shapes can provide added mechanical stiffness and strength.

In a transmitting configuration, an input signal is distributed by the feed network such that it excites the resonating disks at four opposite and orthogonally directed points surrounding an aperture in the circuit cavity. The central pin bisects this aperture in a similar fashion as the penultimate disk. The circuit cavity aperture, unlike the penultimate disk aperture, contains crossed slots. Each of the four branches of these crossed slots are excited via electromagnetic coupling from four microstrip feed lines at four excitation points, defined as the regions where each microstrip feed line crosses over an associated slot. The four microstrip feed lines are each short-circuited at one end while they are connected at four successive points along a single microstrip delay line at their other ends. These four connection points are spaced at quarter wavelength intervals, creating progressive 90° phase delayed excitations in each slot branch, which in turn couple electromagnetically to the disks. This arrangement results in resonant currents continuously flowing in a circle around the disks, giving rise to circularly polarized electromagnetic radiation. The use of four feed points also ensures better circular symmetry than the use of only two feed points, and therefore a wider bandwidth of good circular polarization performance, i.e., low cross-polarization effects, particularly on boresight. For good circular polarization operation off boresight, the E-plane (plane of maximum electric field gradient) and H-plane (plane of maximum magnetic field gradient) radiation patterns, which are in constant rotation, need to be of equal amplitude and phase for corresponding angles away from boresight.

The circuit cavity can be an integral or separate subcomponent of the housing. The housing, in addition to containing the circuit cavity, can serve as the grounding plane for the resonating disks. The said grounding plane can also contain crossed slots. In the disclosed embodiment, the grounding plane is flat, however in other embodiments the grounding plane can be non planar in the form of a bowl or a cone, etc. An optional series of fingers positioned at the edge of the housing can extend parallel to the central pin and towards the resonating disks. These optional fingers can improve the off-boresight losses associated with cross-polarization, and further extend the electrical ground.

The circuit cavity is further designed to hold the circuit in close proximity to the crossed slots in the roof of the circuit cavity. Formed from a conductive material, the circuit receives an input signal and outputs the received signal to four excitation points. Those excitation points in turn couple via the slots to the resonating disks. Unlike standard, planar, microstrip transmission line circuits, the circuit disclosed herein is a non-planar circuit. For example, while all the microstrip transmission lines in the feed network are formed in three dimensions, standard microstrip transmission circuits are formed primarily in two dimensions, length and width, ignoring height. Previous antenna designs incorporate a solid dielectric material, a lightweight honeycomb material or expanded foam material to maintain rigidity, essentially supporting the planar microstrip transmission circuit so that it stays in position and does not bend. These standard microstrip transmission circuits also can utilize solder to maintain connections between the circuit and the antenna input/output port, as well as the antenna points or resonating disks. Soldering can be eliminated with standard planar microstrip transmission lines by also using slots in a ground plane to couple to the resonating disks, but the limited two-dimensional topology usually requires longer and awkwardly meandering microstrip feed lines to reach the excitation points while maintaining proper separation from the slots. This is a consequence of the fact that the three $\lambda/4$ long microstrip delay line sections usually cannot circle the relatively large crossed slot aperture geometrically in a full 270° arc to allow equal lengths of feed lines to reach the feed points.

By contrast, the disclosed circuit, which is topologically equivalent to a microstrip transmission line, utilizes a non-planar design to overcome the layout problems of two dimensions. In the disclosed circuit for instance, the effective lengths of the delay line sections are shortened by curving them into a cylinder. A conical curvature may also have been used instead, for longer or shorter effective delay line lengths. In addition, the circuit has sufficiently low mass with interconnecting support and curvature in three-dimensions, length, width, and height, to provide sustainable rigidity. In one example, to assure impedance matching everywhere along the circuit, and that the correct phase and power is maintained at each of the excitation points, the strip width in the circuit decreases from the input point to the final excitation point. The amount of mass can be reduced by reducing the separation between the circuit and the cavity walls, thereby requiring a corresponding reduction in strip width to maintain the same transmission line impedance, or by decreasing the thickness of the microstrip transmission circuit, for example. Other mass reduction approaches can be used as well. In another approach, the above mass reduction methods can be replaced by or used in conjunction with different materials which have lower density but sufficiently high surface conductivity, such as low density metals or metal plated plastics. The central pin extends through an aperture in the non-planar circuit, after which it connects to the lid, at which point the antenna can be connected to a satellite, a vehicle, a fixed object, and/or any other location.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

The present disclosure addresses the need in the art for low-maintenance, solderless and virtually dielectric free antenna with low cross-polarization. When used herein, such terms as "horizontal", "vertical", "top", "bottom", "upper", "lower", "left" and "right" are for descriptive purposes only and are not intended to limit the antenna or components thereof to any particular orientation. Furthermore, the antenna disclosed herein can be reciprocal in that it can receive signals as well as transmit them. Consequently, references herein to "transmitting", "radiating", and "generating" signals apply equally to receiving signals. The antenna disclosed herein will be further described with reference to FIGS. 1-8. The disclosure now turns to FIG. 1.

Figure 1:
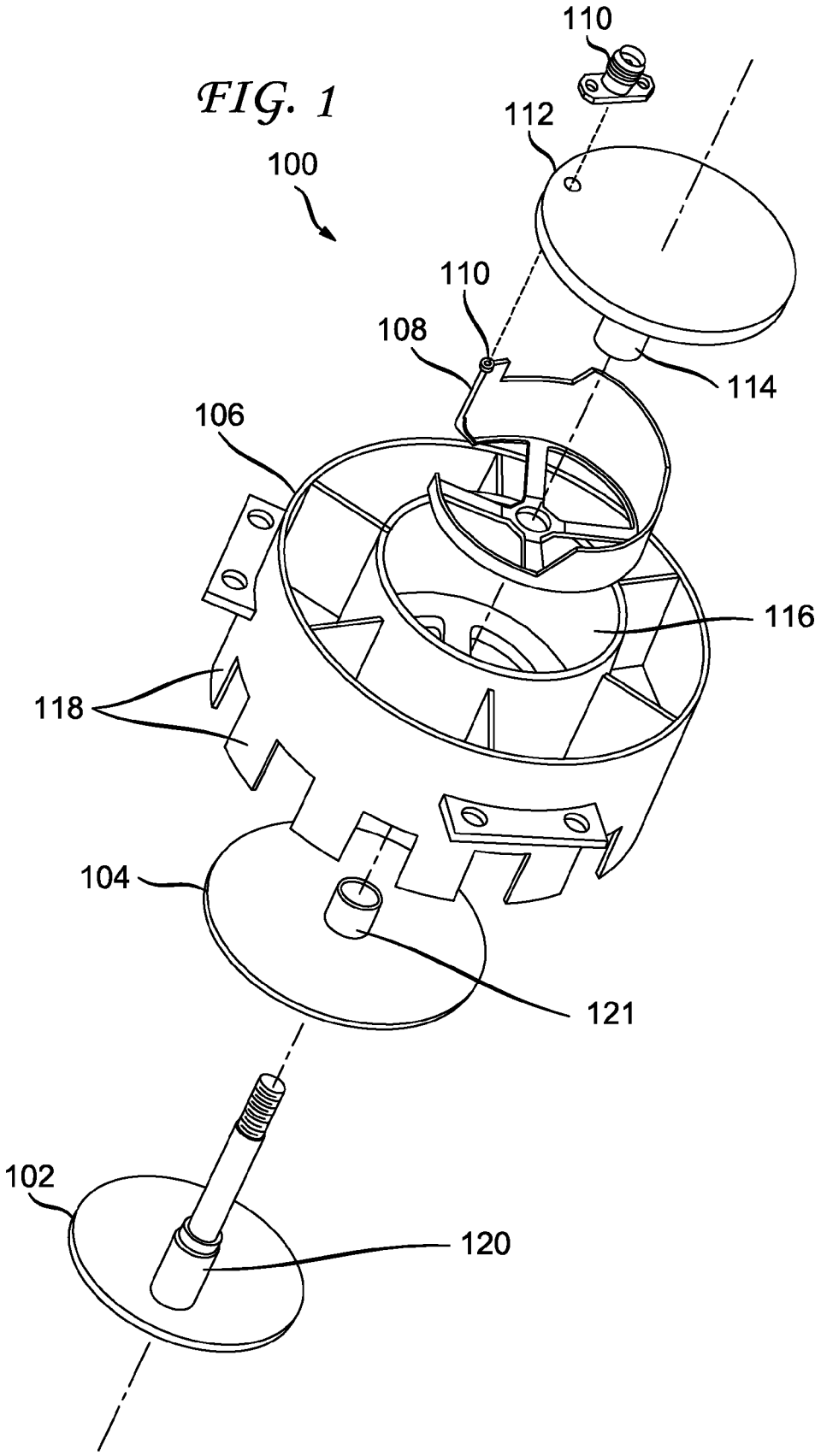
FIG. 1 illustrates an example of the unassembled antenna.

FIG. 1 illustrates an example of an unassembled antenna 100. The exemplary order of the unassembled antenna 100 begins with an upper disk 102. The upper disk 102 is curved toward the remainder of the antenna 100 body. The upper disk 102 connects to the lower disk 104, which is curved towards the upper disk 102. The lower disk 104 is in turn followed by the housing 106, which contains fingers 118 and a circuit cavity 116. The circuit cavity 116 is designed to hold the circuit 108. The circuit 108 optionally contains and/or interfaces with an I/O port 110, where the circuit 108 receives the signal to be transmitted. The lid 112 follows the circuit 108. While the lid 112 represents one end of the antenna 100 structure, the side of the lid 112 facing the other components of the antenna attaches to a central post segment 114, which secures the central pin 120. The central pin 120 attaches to the upper disk 102, bisects non-illustrated apertures in the lower disk 104, the spacer 121, the circuit cavity 116, the circuit 108, and then connects the central post segment 114 of the lid 112.

Figure 2:
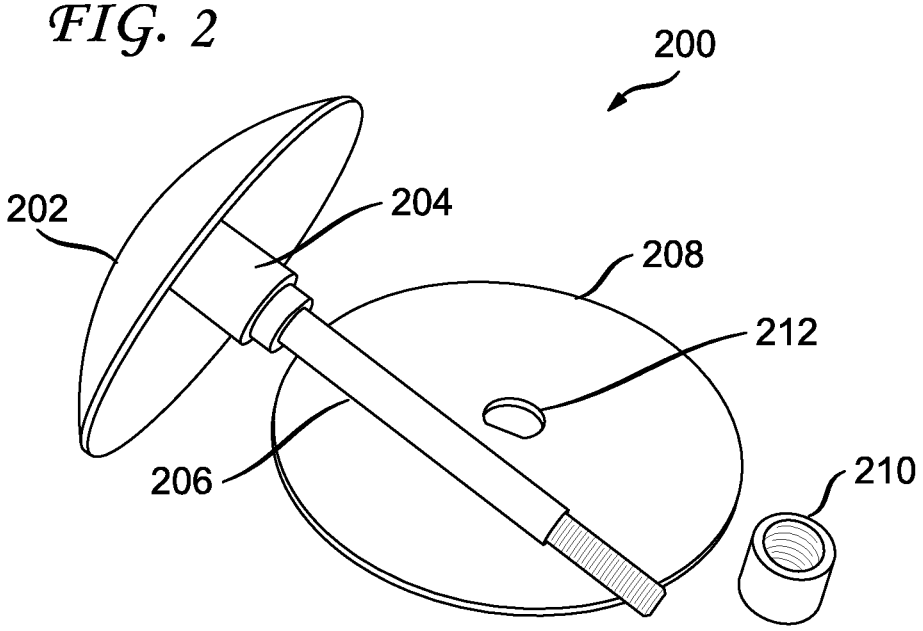
FIG. 2 illustrates exemplary resonating disks unassembled.

Having described the overall configuration of the antenna, the disclosure turns to some exemplary components in more detail. FIG. 2 illustrates exemplary unassembled resonating disks 200. The exemplary disks 200 are curved, however the disks 200 can also be flat or take other shapes in accordance with desired propagation and signal reception characteristics. The advantages of curving the disks are mechanical stiffening and the ability to partially equalize the E-plane and H-plane patterns of the antenna over wide angles, which improves circular polarization away from boresight. The upper disk 202 is curved, and attaches to a central pin receptacle 204. This receptacle 204 can be a solid piece including the upper disk 202, or can be a separate piece crimped or otherwise attached to the upper disk 202. The central pin 206 fits within the receptacle 204 or can be a solid extension of the receptacle 204. A second disk 208, corresponding to the lower disk 104 of FIG. 1, curves into a bowl shape similar to the upper disk 202. The radii of curvature of the disks can be identical, or as illustrated, they can differ. The bowl faces of the disks 202, 208 can face one another, but can alternatively face opposite to one another or in the same direction. One or more of the disks can be flat while only a single disk is bowl shaped. The lower disk 208 contains an aperture 212, or hole, through which the central pin 206 can pass. The receptacle 204 maintains the proper spacing between the upper disk 202 and lower disk 208, and a washer or spacer 210 between lower disk 208 and the circuit 108 of FIG. 1 can create the proper distance between the disks and the circuit to control resonance. In a space environment, where atomic oxygen can rapidly corrode most dielectrics and some metals, the spacing of these gaps can be critical to antenna operation, therefore all parts should preferably be gold plated. In terrestrial environments, dielectric spacers can be placed between the disks 202, 208 and the circuit.

Figure 3:
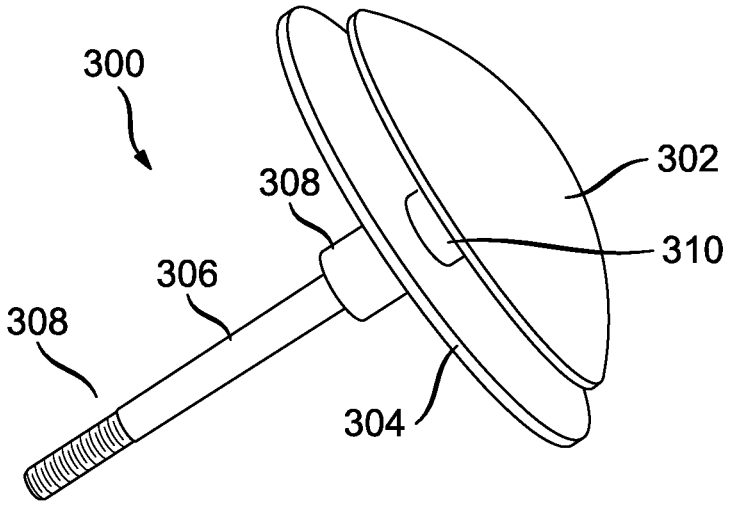
FIG. 3 illustrates exemplary resonating disks assembled.

FIG. 3 illustrates the exemplary resonating disks of FIG. 2 after being assembled 300. The upper disk 302 is connected directly to the lower disk 304 with no dielectric. The spacing between the disks 302, 304 exists due to the central pin receptacle 310. The central pin 306 feeds through the aperture in the lower disk 304 to connect to the upper disk 302, and the spacer 308 maintains the proper spacing between the disks and the circuit 108 of FIG. 1.

Figure 4:
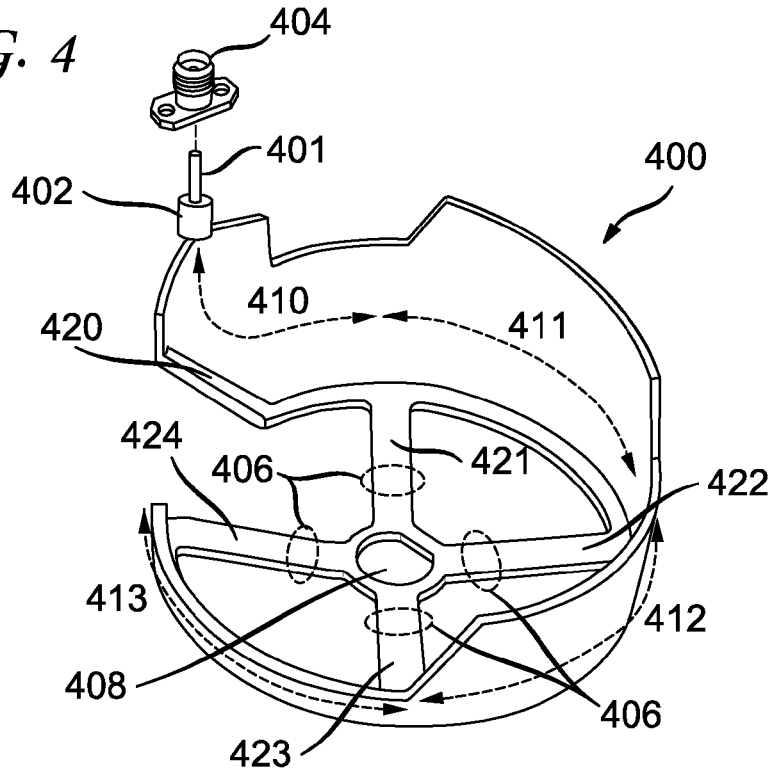
FIG. 4 illustrates an exemplary circuit component.

FIG. 4 illustrates an exemplary circuit 400. The I/O port 404 in the form of a RF connector, engages with the pin 401 to make contact with the circuit 400. The dielectric bush 402, which is the only non-conductive part of the circuit 400, supports and guides the pin 401 through a cylindrical hole in the lid 112 of FIG. 1 and maintains the 50Ω characteristic wave impedance of the port 404. The illustrated circuit 400 is designed such that a signal, received through the I/O port 404, is conducted through the conductive material of the circuit 400 to the excitation points 406. The conductive parts of the circuit 400 guides the signal currents at non-zero potential, while the surfaces of the circuit cavity 116 and of the central post segment 114 and spacer 121 of FIG. 1, which are in closest proximity to the circuit 400, are at zero or ground potential. The excitation points 406 surround a mechanical aperture 408 in the center of the circuit 400, which provides mechanical support and to allow the central pin 120 of FIG. 1 to pass through it. The signal first passes through a wave impedance matching microstrip line section 410, at which stage 25% of the energy is bled off along a short high impedance microstrip feed line 421 towards the first of the excitation points 406. The remaining 75% of the signal energy then pass through a quarter wavelength long microstrip delay line section 411 of relatively low wave impedance before 25% more of the signal is bled off along a second short high impedance microstrip feed line 422 to the second of the excitation points 406. The remaining 50% of the signal energy subsequently pass through another quarter wavelength long microstrip delay line section 412 of a wave impedance about 1.5 times higher than the previous section 411, before 25% more of the signal is bled off via a third short high impedance microstrip feed line 423 to the third of the excitation points 406. The last 25% of the signal energy finally pass through a final quarter wavelength long microstrip delay line section 413 of a wave impedance about twice as high as the previous section 412, before it is delivered via a fourth short high impedance microstrip feed line 424 to the fourth and last of the excitation points 406. Due to the quarter wavelength long microstrip delay line sections, each successive excitation point is delayed by 90° in phase compared to the previous point. The four short microstrip feed line sections 421, 422, 423 and 424 are aligned in the form of a crossbar and connect together in the center at ground potential, i.e. they are short circuited. The circuit 400 is designed in a non-planar fashion, in the form of conductive strips that conformally follow the walls of the cylindrical circuit cavity. The matching section 410, and the quarter wavelength delay line sections 411, 412 and 413 follows along the curvature of cylindrical circuit cavity 116 of FIG. 1. These sections also have a folded edge 420 for added strength and rigidity. The four short feed lines 421, 422, 423 and 424 follow the non-planar conical shaped roof of the circuit cavity 116 of FIG. 1. The interconnection of the different sections and the non-planar shapes form a very rigid mechanical structure, allowing the circuit 400 to be supported only where it engages with the connector 404 and where it is clamped at the center between the central post segment 114 and spacer 121 of FIG. 1. The length, width, and thickness of the conductive material 402, as well as the circuit's separation distance from the walls of the circuit cavity 116 of FIG. 1, are adjustable to maintain the proper characteristic wave impedance everywhere from the I/O port 404 to the excitation points 406. In a microstrip line, the characteristic wave impedance is reduced with an increase of the strip width and to a much lesser extend by an increase in the thickness. The characteristic wave impedance increases when the strip's separation from the grounded conductor is increased. The high mechanical rigidity of the circuit 400 therefore ensures integrity of the microstrip line sections' characteristic wave impedances, which are very sensitive to changes in the small separation distance between the circuit 400 and the walls of circuit cavity 116 of FIG. 1. The lengths of the short sections 421, 422, 423 and 424, i.e. the "crossbars" leading to the excitation points 406, as well as the radius of curvature of the sections 410, 411, 412 and 413 are determined in part by the wavelength and frequency of the signal being transmitted. Ideally, each of the excitation points 406 is 90° out of phase from the other neighboring excitation points, requiring a difference of or λ/4 (wavelength/4) between the points. The circuit can be changed in terms of shape, length, size, and/or any other physical characteristic that influences characteristic impedance and transmission line length, as long as the combined effects still maintain the desired design values.

The crossbars leading to the excitation points 406 in this illustrated example are connected at a central point containing the aperture 408, allowing the excitation points 406 to be located as close as possible to the central axis of the antenna. This is desirable since decreasing the distance between the excitation points 406 and the central axis improves off-boresight cross-polarization.

Figure 5:
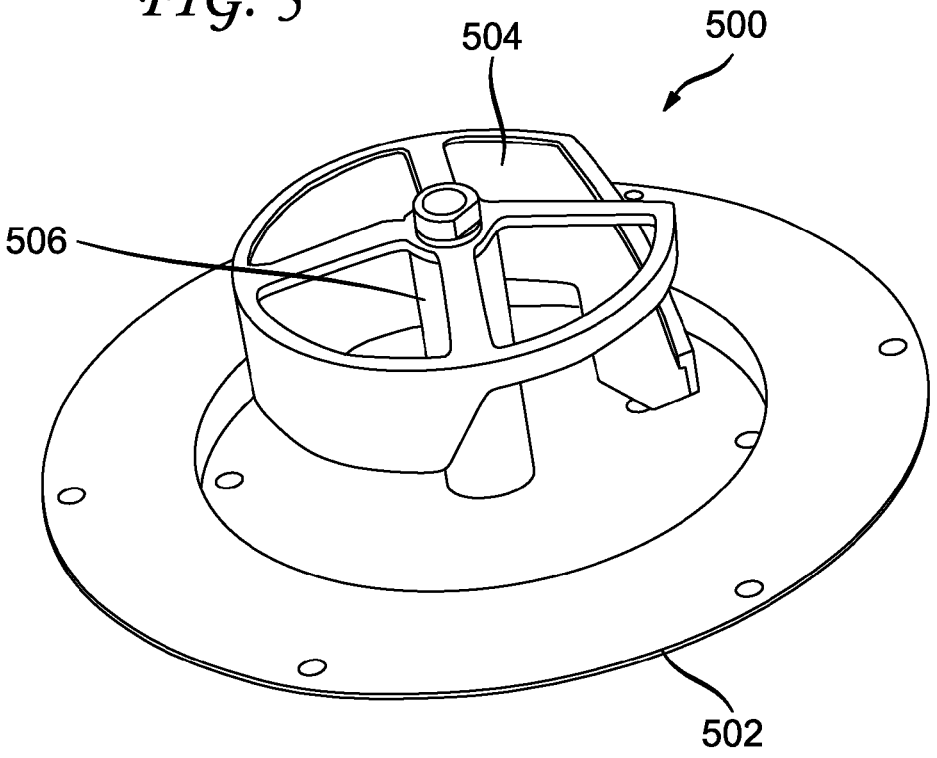
FIG. 5 illustrates an exemplary circuit assembled with an exemplary lid.

FIG. 5 illustrates an exemplary circuit assembled with an exemplary lid. This illustrated assembly 500 has a lid 502 connected to a circuit 504 similar to that shown in FIG. 4. The lid also has a central post segment 506, which allows for a non-solder based connection to the circuit 504. The non-solder based connection can include crimping and screwing.

Figure 6A:
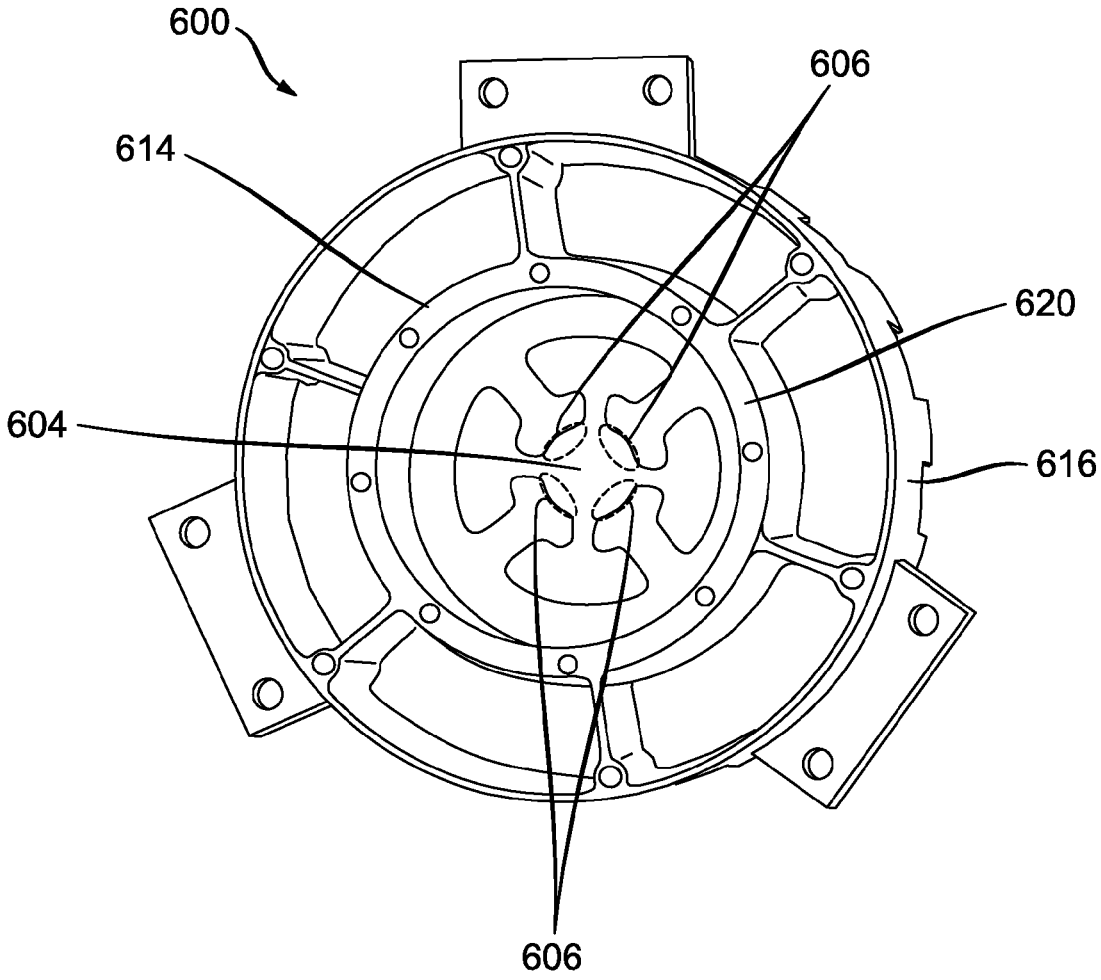
FIGS. 6*a* and 6*b* illustrate an exemplary housing component.
Figure 6B:
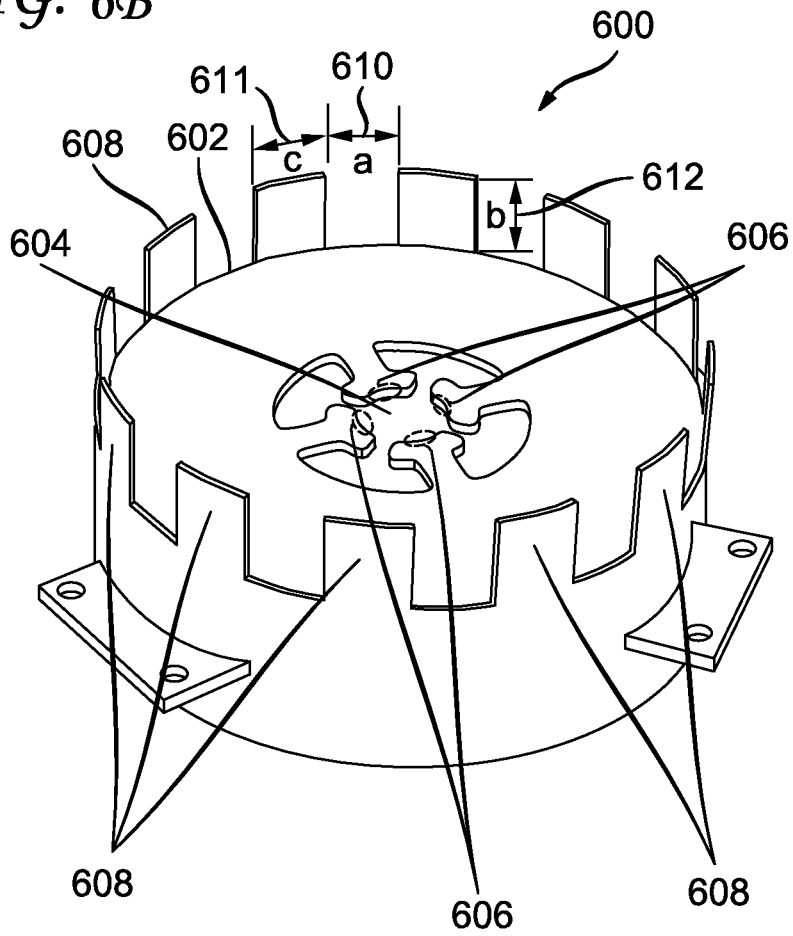

FIGS. 6A and 6B illustrate different perspectives of the housing 600. In FIG. 6B, the housing 600 has a flat circular area 602 that acts as the ground plane for the disks 102 and 104 of FIG. 1. The edge of circle 602 also supports fingers 608, which provide a different coupling mechanism for E-plane fields than the H-plane fields to interact with the ground surface, thereby providing improved off-axis cross-polarization and an improved signal with reduced cross-polarization loss. These fingers 608 have a gap component a 610, a width component c 611 and a height component b 612. In this example, both a 610 and c 611 are roughly equal, however other embodiments can have different widths and gap sizes. To be effective, a 610 and c 611 should be significantly less than λ/4. The height b 612 is usually also chosen to be less than λ/4, and increasing it strengthens the effect on the off-boresight cross-polarization. The circular area 602 also contains a cross-dumbell shaped aperture 604 through which the central pin can pass. The gaps between the edges of the aperture 604 near the center and the central pin form the excitation regions 606 where the four crossbar strips from the circuit in FIG. 4 bridge the gaps.

FIG. 6A illustrates the same housing 600, but from beneath. The outer shell 616 with mounting protrusions are visible, as are the aperture 604, and the excitation regions 606. Also visible is the circuit cavity 620, a cavity within the housing shaped to fit the non-planar circuit previously described.

Figure 7A:
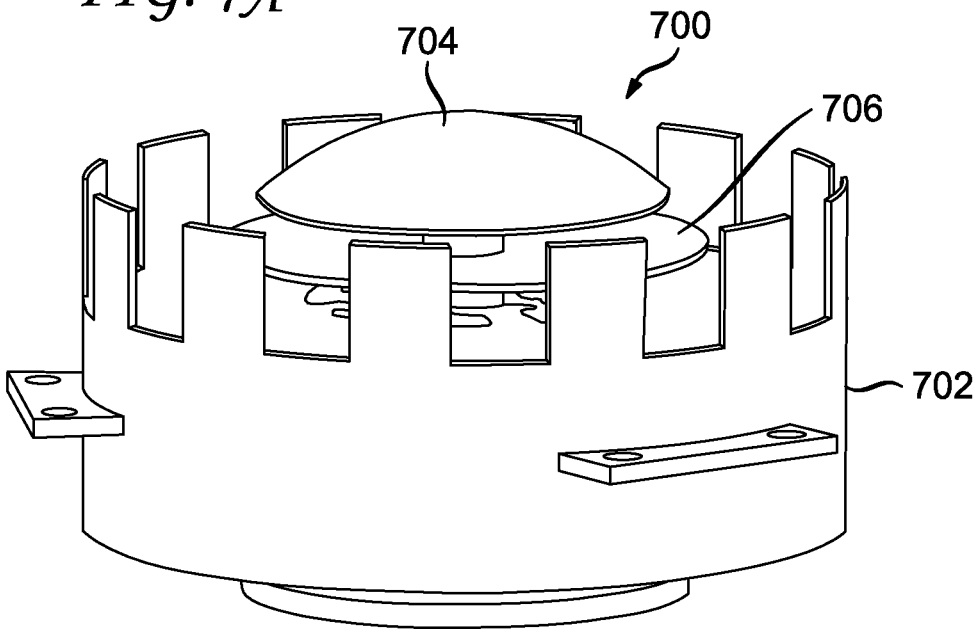
FIGS. 7*a* and 7*b* illustrate an exemplary assembled antenna embodiment.
Figure 7B:
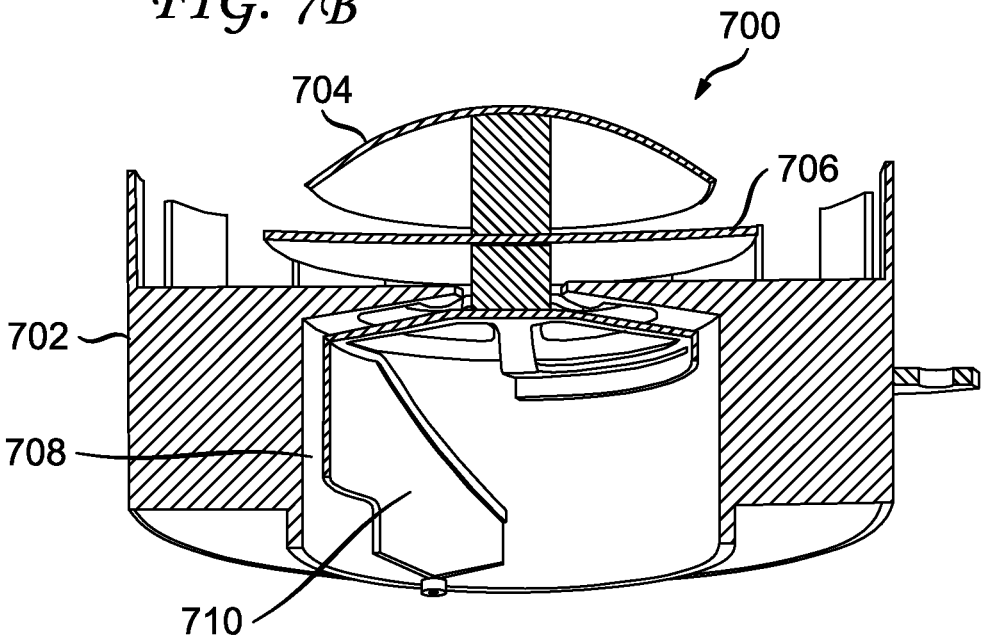

FIGS. 7A and 7B illustrate alternative views of an exemplary assembled antenna 700. FIG. 7A illustrates a non-transparent side view of the assembled antenna 700. Resonating disks 704, 706 top the housing 702. FIG. 7B illustrates the assembled antenna 700 in a transparent side view of the assembled antenna 700. As illustrated, this embodiment has a housing 702, and within that housing 702 is a circuit cavity 708. The top portion of the circuit cavity 708 curves upward, thus requiring the circuit 710 contained within the circuit cavity 708 to have angled crossbars (as opposed to planar crossbars) for additional mechanical rigidity as described earlier. The curvature of the disks 704, 706 are illustrated here, with the lower disk 706 curving towards the upper disk 704 at a different radius of curvature than the upper disk 704, which is curved down toward the antenna structure. As shown in FIG. 7B, the upper disk 704 and the lower disk 706 can have different amounts of curvature, different diameters, and/or be made of different materials.

Figure 8A:
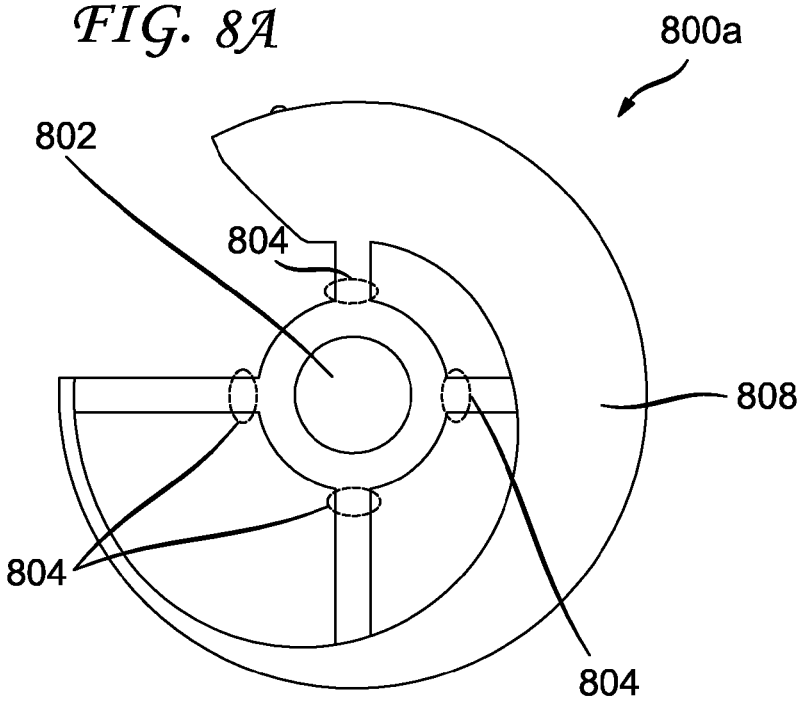
FIGS. 8*a* and 8*b* illustrate a second exemplary circuit component.
Figure 8B:
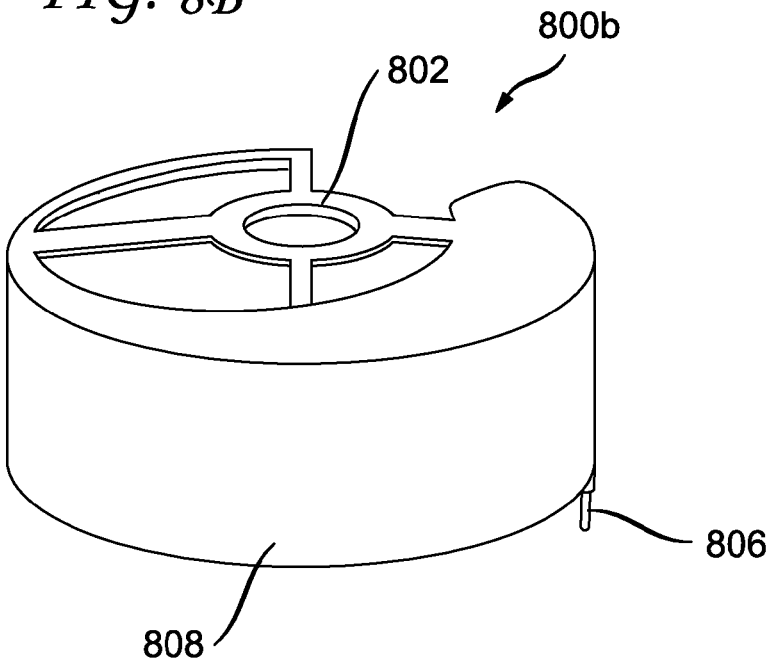

FIGS. 8A and 8B illustrate a second exemplary circuit component 800. FIG. 8A illustrates a top view of this embodiment, and FIG. 8B illustrates the same embodiment from a side view. This example circuit 800 functions equally to the circuit illustrated in FIG. 4, however this circuit 800 maintains the appropriate average transmission line impedance in each section by varying the width of the folded edge rather than the width of the vertical parts of the circuit strips. This can be done as long as the strips do not interfere with the crossed slot aperture in the circuit cavity. The circuit 800 contains an aperture 802, as well as crossbars leading to excitation points 804. These excitation points 804 electromagnetically couple with the crossed slot aperture in the housing in a similar manner to those circuits previously described. The circuit 800 also contains an I/O port 806, after which the folded edge width of the conducting material 808 slowly decreases in a manner that the correct impedance transformation is maintained in each section whilst the effective transmission line lengths are adjusted such that the phase between each excitation point is shifted by 90°. In other variations, the material making up the circuit component 800 can vary. For instance, the circuit component can be made of brass on one side, an alloy of brass and nickel in the middle, and nickel on the other side. The thickness and/or height of the portions of the circuit can be based on the characteristics of the metals making up the respective portions.

The various embodiments described above are provided by way of illustration only and should not be construed to limit the scope of the disclosure. For example, the principles herein apply equally to space and terrestrial antenna systems, and can include multiple layers of disks, multi-band transmission or reception, and can be adjusted to various materials, such as gold, aluminum, or plastics. Those skilled in the art will readily recognize various modifications and changes that may be made to the principles described herein without following the example embodiments and applications illustrated and described herein, and without departing from the spirit and scope of the disclosure.

We claim:

1. An antenna, comprising:

a first bowl-shaped disk;

a second bowl-shaped disk having a second bowl-shaped disk aperture;

a non-planar, self-supporting feed circuit having a non-planar, self-supporting feed circuit aperture;

a circuit cavity for containing the non-planar, self-supporting feed circuit, wherein the circuit cavity has a dielectric free circuit cavity aperture;

a lid; and a solderless central pin connecting to the first bowl-shaped disk at a first end and the lid at a second end, and passing through the dielectric free circuit cavity aperture, the circuit aperture, and the second radiating disk aperture; with the two disks stacked containing crossed slots with a plurality of microstrip feed lines short circuited at one end forming delay lines together creating a wider operational matching bandwidth for outputting an orthogonal signal.

2. The antenna of claim 1, further comprising:

a housing encompassing the circuit cavity.

3. The antenna of claim 2, wherein the housing further acts as a ground plane.

4. The antenna of claim 1, wherein the first bowl-shaped disk, the second bowl-shaped disk, the non-planar, self-supporting feed circuit, the circuit cavity, the lid, and the central pin further comprise a composition material, wherein the composition material comprises at least one of aluminum, gold, nickel, and gold plating.

5. The antenna of claim 1, wherein the non-planar, self-supporting feed circuit receives an input signal from an input port and conducts the input signal to excitation points, creating resonances in the circuit cavity aperture, the first bowl shaped disk and the second bowl shaped disk to yield a circularly polarized signal.

6. The antenna of claim 5, wherein the non-planar, self-supporting feed circuit maintains impedance matching from the input port to the excitation points by tapering at least one of the vertical width, the folded edge width, of the non-planar, self-supporting circuit.

7. An antenna feed circuit comprising:

a non-planar electrical conductor, wherein the non-planar electrical conductor further comprises:

an input port for receiving a signal;

four excitation points for outputting the signal;

tapers from the input port to each of the four excitation points to provide ordered output signals of equal strength with phase shifts of 90° between at least one of a previous output signal and a subsequent output signal at each of the four excitation points;

a non-planar, self-supporting feed circuit having a non-planar, self-supporting feed circuit aperture;

a circuit cavity for containing the non-planar, self-supporting feed circuit, wherein the circuit cavity has a dielectric free circuit cavity aperture;

a lid: and a solderless central pin connecting to the first bowl-shaped disk at a first end and the lid at a second end, and passing through the dielectric free circuit cavity aperture, the circuit aperture, and the second radiating disk aperture; with the two disks stacked containing crossed slots with a plurality of microstrip feed lines short circuited at one end forming delay lines together creating a wider operational matching bandwidth for outputting an orthogonal signal.

8. The antenna feed circuit of claim 7, wherein the input port receives a coaxial cable.

9. The antenna feed circuit of claim 7, wherein tapering from the input port to each of the four excitation points further comprises reducing mass in at least one of the height, the width, and the density of the non-planar electrical conductor.

10. The antenna feed circuit of claim 7, wherein the four excitation points are located on angled arms.

11. The antenna feed circuit of claim 7, wherein the non-planar electrical conductor comprises at least one of aluminum, gold, nickel, and gold plating.

12. The antenna feed circuit of claim 7, wherein the non-planar electrical conductor is used to perform at least one of creating and receiving a circularly polarized microwave signal.

13. An antenna, compising:

a first bowl-shaped disk;

a second bowl-shaped disk having a second bowl-shaped disk aperture;

a non-planar, self-supporting feed circuit having a non-planar, self-supporting feed circuit aperture, wherein the non-planar, self-supporting feed circuit further comprises:

an input port for receiving a signal;

four excitation points for outputting the signal; and tapers from the input port to each of the four excitation points to provide ordered output signals with phase shifts of 90° between at least one of a previous output signal and a subsequent output signal at each of the four excitation points;

a circuit cavity for containing the non-planar, self-supporting feed circuit, wherein the circuit cavity has a circuit cavity aperture;

a lid;

a solderless central pin connecting to the first bowl-shaped disk at a first end and the lid at a second end, and passing through the circuit cavity aperture, the circuit aperture, and the second radiating disk aperture;

a non-planar, self-supporting feed circuit having a non-planar, self-supporting feed circuit aperture;

a circuit cavity for containing the non-planar, self-supporting feed circuit, wherein the circuit cavity has a dielectric free circuit cavity aperture;

a lid; and the solderless central pin connecting to the first bowl-shaped disk at a first end and the lid at a second end, and passing through the dielectric free circuit cavity aperture, the circuit aperture, and the second radiating disk aperture; with the two disks stacked containing crossed slots with a plurality of microstrip feed lines short circuited at one end forming delay lines together creating a wider operational matching bandwidth for outputting an orthogonal signal.

14. The antenna of claim 13, further comprising:

a housing encompassing the circuit cavity.

15. The antenna of claim 14, wherein the housing further acts as a ground plane.

16. The antenna of claim 13, wherein the non-planar, self-supporting feed circuit creates a circularly polarized signal in the first bowl-shaped disk and the second bowl-shaped disk.

17. The antenna of claim 13, wherein the non-planar, self-supporting feed circuit maintains impedance matching from the input port to the excitation points by tapering at least one of the height, the width, and the thickness of the non-planar, self-supporting circuit.

* * * * *